US009149913B2

(12) United States Patent
Gosamo

(10) Patent No.: US 9,149,913 B2
(45) Date of Patent: Oct. 6, 2015

(54) ABRASIVE ARTICLE HAVING SHAPED SEGMENTS

(71) Applicants: Saint-Gobain Abrasives, Inc., Worcester, MA (US); Saint-Gobain Abrasifs, Conflans-Sainte-Honorine (FR)

(72) Inventor: Ignazio Gosamo, Léglise-Thibessart (BE)

(73) Assignee: SAINT-GOBAIN ABRASIVES, INC., Worcester, MA (US)

( * ) Notice: Subject to any disclaimer, the term of this patent is extended or adjusted under 35 U.S.C. 154(b) by 0 days.

(21) Appl. No.: 14/132,140

(22) Filed: Dec. 18, 2013

(65) Prior Publication Data

US 2014/0187130 A1 Jul. 3, 2014

Related U.S. Application Data

(60) Provisional application No. 61/747,965, filed on Dec. 31, 2012.

(51) Int. Cl.
*B24D 5/06* (2006.01)
*B24D 99/00* (2010.01)
(Continued)

(52) U.S. Cl.
CPC ..... *B24D 5/06* (2013.01); *B24D 7/066* (2013.01); *B24D 99/005* (2013.01); *B28D 1/122* (2013.01)

(58) Field of Classification Search
CPC ..... B24D 5/06; B24D 5/123; B24D 5/08; B24D 5/16; B28D 1/121
USPC ..... 451/540–551; 125/13.01
See application file for complete search history.

(56) References Cited

U.S. PATENT DOCUMENTS 232,682 A * 9/1880 Chase ..... 451/112
487,198 A * 11/1892 McCutchan ..... 114/222
(Continued)

FOREIGN PATENT DOCUMENTS

EP 1319471 A1 6/2003
EP 1304190 B1 10/2005
(Continued)

OTHER PUBLICATIONS

Lulusoso.com, "4" Diamond grinding cup wheel for granite," http://sell.lulusoso.com/selling-leads/299041/4-quot-Diamond-grinding-cup-wheel-for-granite.html, Oct. 11, 2011, 4 pages.
(Continued)

*Primary Examiner* — George Nguyen
(74) *Attorney, Agent, or Firm* — Abel Law Group, LLP; Joseph P. Sullivan

(57) ABSTRACT

An abrasive segment can include an inner segment portion, an outer segment portion, and a central segment portion connected thereto. The inner segment portion can include an inner circumferential wall and an outer circumferential wall. Leading and trailing radial sidewalls can extend between the inner circumferential wall and the outer circumferential wall opposite each other. The outer segment portion can include an inner circumferential wall and an outer circumferential wall. Leading and trailing radial sidewalls can extend between the inner circumferential wall and the outer circumferential wall opposite each other. The central segment portion can include a leading radial sidewall and a trailing radial sidewall. The leading radial sidewall of the central segment portion can establish an acute angle, α, with respect to the outer circumferential wall of the inner segment portion and an obtuse angle, β, with respect the inner circumferential wall of the outer segment portion.

20 Claims, 4 Drawing Sheets

(51) Int. Cl.

| | |
|---|---|
| ***B28D 1/12*** | (2006.01) |
| ***B24D 7/06*** | (2006.01) |

(56) References Cited

U.S. PATENT DOCUMENTS

| | | | | | |
|---|---|---|---|---|---|
| 931,483 | A | * | 8/1909 | Puffer et al. | 451/548 |
| 970,618 | A | * | 9/1910 | Gardner | 451/548 |
| 1,027,536 | A | * | 5/1912 | Gardner | 451/548 |
| RE15,245 | E | * | 12/1921 | McGovern | 451/548 |
| 1,470,957 | A | | 10/1923 | Cavicchi | |
| 1,868,492 | A | * | 7/1932 | Bucheister | 451/548 |
| 2,307,312 | A | | 1/1943 | Whiting | |
| 2,307,632 | A | | 1/1943 | Meyer | |
| 2,408,148 | A | * | 9/1946 | Longbotham | 76/25.1 |
| RE23,717 | E | * | 9/1953 | Titcomb | 451/548 |
| 2,883,807 | A | * | 4/1959 | Titcomb | 451/548 |
| 3,745,719 | A | * | 7/1973 | Oswald | 451/548 |
| 3,754,355 | A | | 8/1973 | Hanchett | |
| 3,863,401 | A | | 2/1975 | Schwarzkopf et al. | |
| 4,212,137 | A | | 7/1980 | Rue | |
| 4,624,237 | A | * | 11/1986 | Inoue | 125/15 |
| 4,637,370 | A | * | 1/1987 | Ishizuka | 125/15 |
| 5,040,341 | A | * | 8/1991 | Okinaga | 451/541 |
| 5,177,908 | A | * | 1/1993 | Tuttle | 451/41 |
| 5,454,752 | A | | 10/1995 | Sexton et al. | |
| 5,560,348 | A | * | 10/1996 | Markley et al. | 125/15 |
| 5,791,330 | A | * | 8/1998 | Tselesin | 125/15 |
| 5,911,620 | A | * | 6/1999 | Spangenberg et al. | 451/548 |
| D437,540 | S | | 2/2001 | Suzuki | |
| D442,196 | S | | 5/2001 | Hansson et al. | |
| D447,757 | S | | 9/2001 | Rautio | |
| 6,283,845 | B1 | * | 9/2001 | Fischbacher et al. | 451/542 |
| 6,299,522 | B1 | | 10/2001 | Lee | |
| D463,965 | S | | 10/2002 | Lee et al. | |
| 6,527,634 | B2 | | 3/2003 | Lee et al. | |
| D474,954 | S | | 5/2003 | Kim et al. | |
| D481,045 | S | | 10/2003 | Ahn | |
| 6,814,657 | B2 | | 11/2004 | Spangenberg et al. | |
| D502,712 | S | | 3/2005 | Eriksson | |
| D509,519 | S | | 9/2005 | Sollami | |
| 6,949,012 | B2 | * | 9/2005 | Barnett, III | 451/56 |
| 7,066,795 | B2 | * | 6/2006 | Balagani et al. | 451/285 |
| D537,854 | S | | 3/2007 | Tong | |
| D548,758 | S | | 8/2007 | Park | |
| D566,141 | S | | 4/2008 | Park | |
| 7,364,502 | B2 | * | 4/2008 | Ficai | 451/548 |
| D582,446 | S | | 12/2008 | Park | |
| D595,750 | S | | 7/2009 | Ericksson et al. | |
| D607,025 | S | | 12/2009 | Niemi et al. | |
| D624,569 | S | | 9/2010 | Norling | |
| D698,375 | S | | 1/2014 | Gosamo | |
| 2002/0178890 | A1 | * | 12/2002 | Okuda et al. | 83/835 |
| 2003/0073393 | A1 | * | 4/2003 | Noguchi | 451/285 |
| 2003/0139128 | A1 | * | 7/2003 | Spangenberg et al. | 451/548 |
| 2008/0287049 | A1 | * | 11/2008 | Salzgeber et al. | 451/548 |
| 2011/0143641 | A1 | * | 6/2011 | Ramanath et al. | 451/548 |

FOREIGN PATENT DOCUMENTS

| | | | |
|---|---|---|---|
| EP | 1074347 | B1 | 11/2005 |
| KR | 10-0314287 | B1 | 11/2001 |
| WO | 2014105638 | A1 | 7/2014 |

OTHER PUBLICATIONS

Amazon.com, "Americut Arrow FPA7T Segmented Turbo Cup Wheel, Threaded 5/8-Inch-11 Thread," http://www.amazon.com/Americut-FPA7T-Segmented-Threaded-8-Inch-11/dp/B002UTJFD2/ref=sr_1_cc_1?s=aps&ie=UTF8&qid=1379015708&sr-1-1-catcorr&keywords=Americut+Arrow+FPA7T+Segmented+Turbo+Cup+Wheel%2C+Threaded+5%2F8-Inch-11+Thread, Nov. 13, 2009, 3 pages.

Amazon.com, "GW1 Super Premium Diamond Cup Wheels Size: 5" x 5/8"-11 THD," http://www.amazon.com/Super-Premium-Diamond-Wheels-Size/dp/B0014GO86Q/ref=sr_1_fkmr0_3?s=hi&ie=UTF8&qid=1379015834&sr=1-3-fkmr0&keywords=GW1+Super+Premium+Diamond+Cup+Wheels+Size%3A+5%22+x+5%2F8%22-11+THD, Nov. 30, 2007, 3 pages.

Amazon.com, "5" with 7/8"-5/8" arbor," http://www.amazon.com/NOVA-arbor/dp/B005G0FPJK/ref=sr_1_15?s=hi&ie=UTF8&qid=1379015949&sr=1-15&keywords=nova+arbor, Aug. 5, 2011, 4 pages.

Amazon.com, "Q4 4" 5/8"-11 Turbo T-Cup Coarse Diamond Wheel," http://www.amazon.com/Q4-Turbo-T-Cup-Coarse-Diamond/dp/B001RQJM4Q/ref=sr_1_fkmr2_2?s=hi&ie=UTF8&qid=1379016474&sr=1-2-fkmr2&keywords=Q4+4%22+5%2F8%22-11+Turbo+T-Cup+Coarse+Diamond+Wheel, Jun. 23, 2011, 3 pages.

Amazon.com, "5" with 7/8" arbor," http://www.amazon.com/5-with-7-8-arbor/dp/B005G0FMUM/ref=sr_1_15?s=hi&ie=UTF8&qid=1379016586&sr=1-15&keywords=tdc+diamond+arbor, Aug. 5, 2011, 3 pages.

Amazon.com, "Viggor 7 In. Supreme Turbo Diamond Cup Wheel 7 with Nut 18 Segments 5/8-11: 3 Pack," http://www.amazon.com/Viggor-Supreme-Turbo-Diamond-Segments/dp/B004TVNV52/ref=sr_1_1?s=hi&ie=UTF8&qid=1379016680&sr=1-1&keywords=Viggor+7+In.+Supreme+Turbo+Diamond+Cup+Wheel, Oct. 25, 2011, 3 pages.

Amazon.com, "4" S33 Smooth Face Resin Filled Cup Wheels Size: Medium," http://www.amazon.com/Smooth-Face-Resin-Filled-Wheels/dp/B003SM3TXM, Jun. 21, 2010, 3 pages.

Amazon.com, T-Segment Cup Wheels Cup Wheels Size: 4", http://www.amazon.com/T-Segment-Cup-Wheels-Size/dp/B002C407P0/ref=sr_1_1?s=hi&ie=UTF8&qid=1379017168&sr=1-1&keywords=mk+diamond+166377, Sep. 14, 2004, 3 pages.

Regent Stone Products, "Weha WX2 Multi Blade/Cup Wheel," http://www.regentstoneproducts.com/item_detail2.aspx?ItemCode=WEHAWX2, May 1, 2012, 1 page.

Samedia, "Diamond Tools," http://web.archive.org/web/20120110111831/http:/www.samedia.com/frances/plateaux_de_surfacage.htm, Jan. 10, 2012, 1 page.

International Search Report for PCT Application No. PCT/US2013/076569 Dated Apr. 8, 2014.

* cited by examiner

ABRASIVE ARTICLE HAVING SHAPED SEGMENTS

CROSS-REFERENCE TO RELATED APPLICATION(S)

This application claims priority to U.S. Patent Application No. 61/747,965 entitled "Abrasive Article Having Shaped Segments," by Ignazio Gosamo, filed Dec. 31, 2012, which application is assigned to the current assignees hereof and incorporated herein by reference in its entirety.

BACKGROUND

1. Field of the Disclosure

The following is generally directed to abrasive tools and processes for forming same, and more particularly, to abrasive tools utilizing abrasive segments attached to a base and methods of assembling such tools.

2. Description of the Related Art

Tools necessary for furthering infrastructure improvements, such as building additional roads and buildings, are vital to the continued economic expansion of developing regions. Additionally, developed regions have a continuing need to replacing aging infrastructure with new and expanded roads and buildings.

The construction industry utilizes a variety of tools for cutting and grinding of construction materials. Cutting and grinding tools are required for to remove or refinish old sections of roads. Additionally, quarrying and preparing finishing materials, such as stone slabs used for floors and building facades, require tools for drilling, cutting, and polishing. Typically, these tools include abrasive segments bonded to a base element or core, such as a plate or a wheel. As with other industries, improvements to these abrasive tools are always sought.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

According to an embodiment, the abrasive article herein can include a core and a plurality of abrasive segments affixed to the core. The abrasive article can be a grinding tool for grinding metal, concrete, or natural stone.

Figure 1:
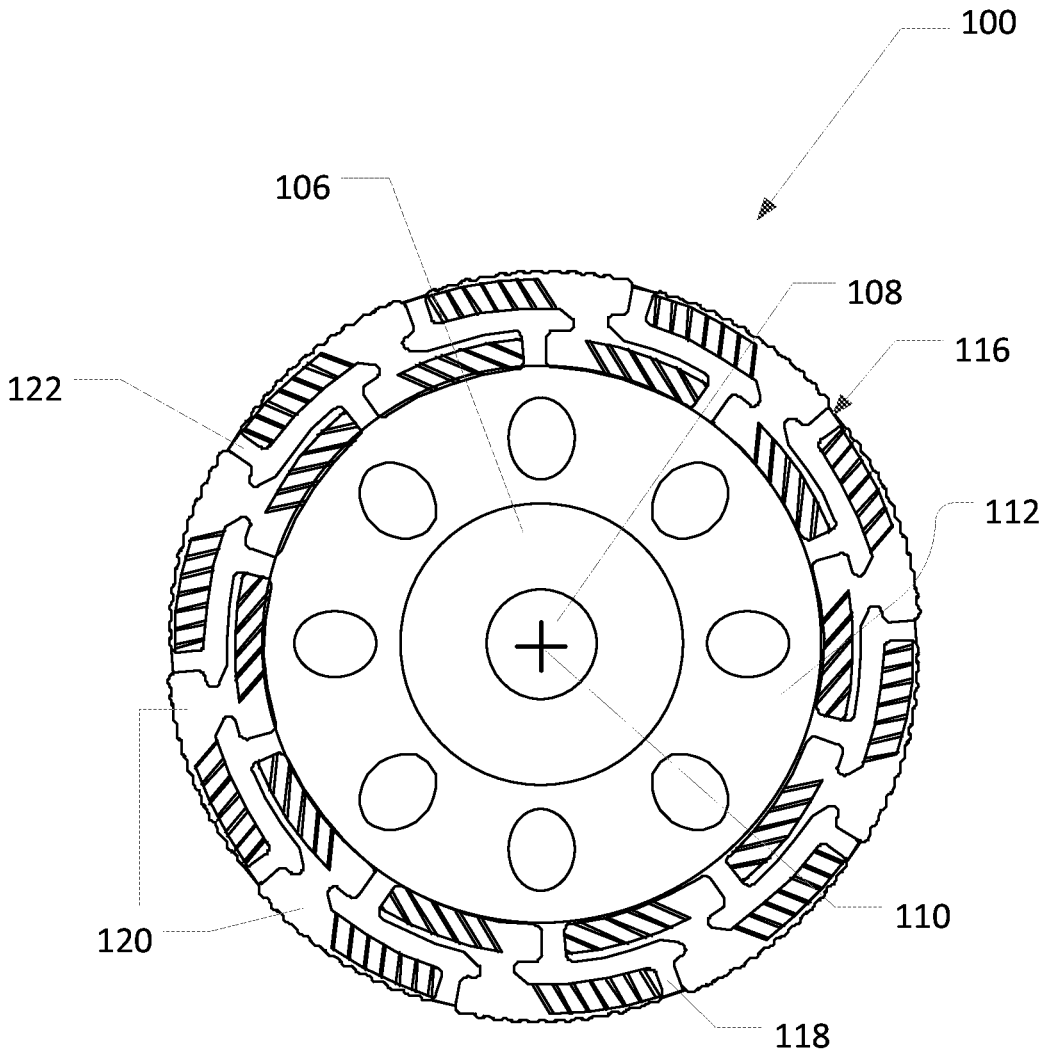
FIG. 1 includes a first plan view of an abrasive article in accordance with an embodiment.
Figure 2:
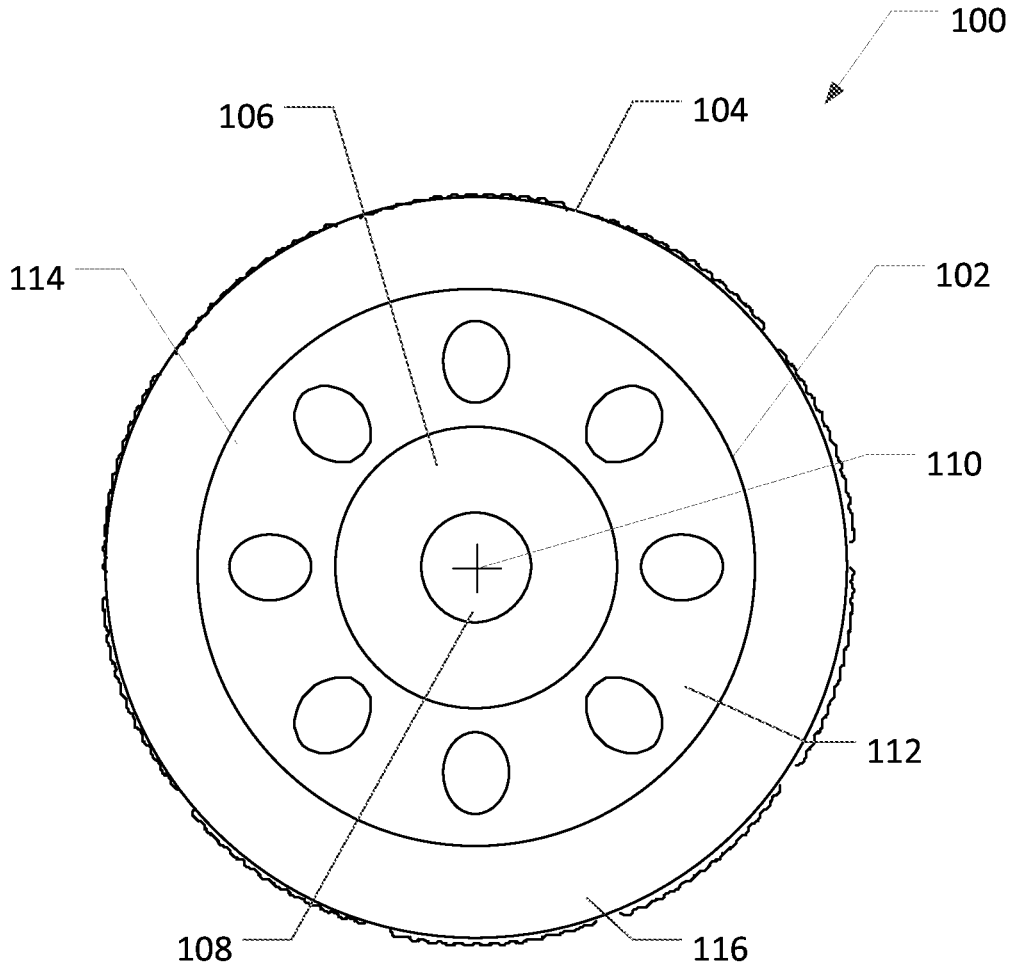
FIG. 2 includes a second plan view of an abrasive article in accordance with an embodiment.
Figure 4:
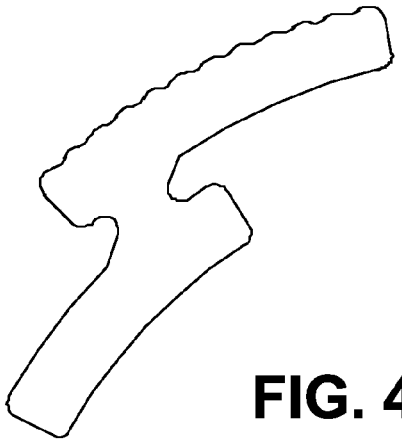
FIG. 4 includes a second plan view of a segment for an abrasive article in accordance with an embodiment.
Figure 5:
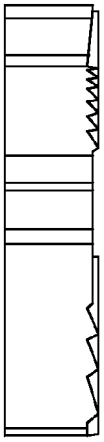
FIG. 5 includes a third plan view of a segment for an abrasive article in accordance with an embodiment.
Figure 6:
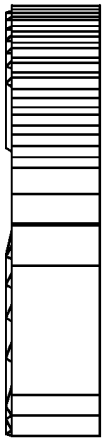
FIG. 6 includes a fourth plan view of a segment for an abrasive article in accordance with an embodiment.
Figure 7:
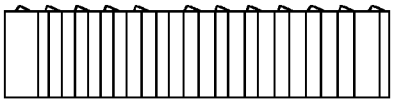
FIG. 7 includes a fifth plan view of a segment for an abrasive article in accordance with an embodiment.
Figure 8:
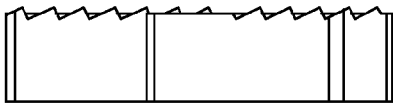
FIG. 8 includes a sixth plan view of a segment for an abrasive article in accordance with an embodiment.

In general, the abrasive article can include multiple Z-shaped segments affixed to a core. FIG. 1 and FIG. 2 illustrate an exemplary abrasive article designated 100. FIG. 1 includes a front plan view of the abrasive article 100. FIG. 2 includes a rear plan view of the abrasive article 100. FIG. 3 through FIG. 8 include various views of a shaped segment that can be installed on the core. Specifically, FIG. 3 includes a front plan view of the segment. FIG. 4 includes a rear plan view of the segment. FIG. 5 includes a left side plan view. FIG. 6 includes a right side plan view. FIG. 7 includes a top plan view and FIG. 8 includes a bottom plan view of the segment. FIG. 8 includes an enlarged bottom plan view of the segment.

FIG. 1 and 2 illustrates an exemplary abrasive article designated 100. As depicted, the abrasive article 100 can include a generally cup-shaped core 102. The core 102 can include a body 104 having a generally disc-shaped central hub 106 formed with a central bore 108 along a center 110 of the core 102. The center 110 of the core 102 is also the center 110 of the abrasive article 100.

A generally frusto-conical sidewall 112 can extend radially outward and axially from the central hub 106 at an angle with respect to the central hub 106. The sidewall 112 can include a distal end 114 and a generally ring-shaped segment support flange 116 can extend radially outward from the distal end 114 of the frusto-conical sidewall 112. The segment support flange 116 can include a face 118 perpendicular to a direction of rotation of the abrasive article 100 around a central axis passing perpendicularly through the center 110 of the abrasive article 100.

A plurality of abrasive segments 120 can be affixed to the face 118 of the segment support flange 116 can extend axially away from the segment support flange 116 in a direction parallel to the central axis. The segments 120 can be formed separately from the core 102, as described herein, and affixed to the core via a brazing procedure, a welding procedure, a mechanical coupling, etc. In a particular aspect, each adjacent pair of segments 120 can be separated by a gap 122.

FIG. 3 through FIG. 8 illustrate the details of one of the segments 120. As illustrated, the segment 120 can include a body 130 that can include a generally curved inner segment portion 132 and a generally curved outer segment portion 134 spaced a radial distance, d, from the inner segment portion 132. The body 132 of the segment 130 can also include a central segment portion 136 connected to the inner segment portion 132 and the outer segment portion 134.

In a particular aspect, the inner segment portion 132 can include an inner circumferential wall 140 and an outer circumferential wall 142. The inner segment portion 132 can also include a leading radial sidewall 144 extending between the inner circumferential wall 140 and the outer circumferential wall 142 and a trailing radial sidewall 146 extending between the inner circumferential wall 140 and the outer circumferential wall 142 opposite the leading radial sidewall 144. The terms leading and trailing, as used herein, can be defined based on a direction of rotation of the abrasive article 100, which is counter-clockwise in the view illustrated in FIG. 1.

As illustrated, the inner segment portion 132 can further include a first grinding face 148 that can extend between the inner and outer circumferential walls 140, 142 and the leading and trailing radial sidewalls 144, 146. Moreover, a first serrated portion 150 can extend at least partially over the first grinding face 148. In a particular aspect, the first grinding face 148 can include an area, $A_{GF1}$, and the first serrated portion 150 can include an area, $A_{SP1}$. $A_{SP1}$ can be $<A_{GF1}$. For example, $A_{SP1}$ can be ≤80% $A_{GF1}$, such as ≤75% $A_{GF1}$, ≤70% $A_{GF1}$, ≤65% $A_{GF1}$, or ≤60% $A_{GF1}$. Further, $A_{SP1}$ can be ≤30% $A_{GF1}$, such as ≥35% $A_{GF1}$, ≥40% $A_{GF1}$, ≥45% $A_{GF1}$, or ≥50% $A_{GF1}$. In another aspect, $A_{SP1}$ can be within a range between and including any of the maximum and minimum values of $A_{SP1}$ described herein.

For example, $A_{SP1}$ can be ≤80% $A_{GF1}$ and ≥30% $A_{GF1}$, such as ≤80% $A_{GF1}$ and ≥35% $A_{GF1}$, ≤80% $A_{GF1}$ and ≥40% $A_{GF1}$, ≤80% $A_{GF1}$ and ≥45% $A_{GF1}$, or ≤80% $A_{GF1}$ and ≥50% $A_{GF1}$. $A_{SP1}$ can be ≤75% $A_{GF1}$ and ≥30% $A_{GF1}$, such as ≤75% $A_{GF1}$ and ≥35% $A_{GF1}$, ≤75% $A_{GF1}$ and ≥40% $A_{GF1}$, ≤75% $A_{GF1}$ and ≥45% $A_{GF1}$, or ≤75% $A_{GF1}$ and ≥50% $A_{GF1}$. $A_{SP1}$ can be ≤70% $A_{GF1}$ and ≥30% $A_{GF1}$, such as ≤70% $A_{GF1}$ and ≥35% $A_{GF1}$, ≤70% $A_{GF1}$ and ≥40% $A_{GF1}$, ≤70% $A_{GF1}$ and ≥45% $A_{GF1}$, or ≤70% $A_{GF1}$ and ≥50% $A_{GF1}$. Further, $A_{SP1}$ can be ≤65% $A_{GF1}$ and ≥30% $A_{GF1}$, such as ≤65% $A_{GF1}$ and ≥35% $A_{GF1}$, ≤65% $A_{GF1}$ and ≥40% $A_{GF1}$, ≤65% $A_{GF1}$ and ≥45% $A_{GF1}$, or ≤65% $A_{GF1}$ and ≥50% $A_{GF1}$. Still further, $A_{SP1}$ can be ≤60% $A_{GF1}$ and ≥30% $A_{GF1}$, such as ≤60% $A_{GF1}$ and ≥35% $A_{GF1}$, ≤60% $A_{GF1}$ and ≥40% $A_{GF1}$, ≤60% $A_{GF1}$ and ≥45% $A_{GF1}$, or ≤60% $A_{GF1}$ and ≥50% $A_{GF1}$.

In a particular aspect, the inner segment portion 132 can have a first radial width, $W_1$, measured from the inner circumferential wall 140 to the outer circumferential wall 142. $W_1$ can be ≥d, described above. For example, $W_1$ can be ≥105% d, such as ≥110% d, or ≥125% d. In another aspect, $W_1$ can be ≤200% d, such as ≤175% d, or ≤150% d. $W_1$ can also be within a range between and including any of the maximum and minimum values of $W_1$ described herein.

For example, $W_1$ can be ≥105% d and ≤200% d, such as ≥105% d and ≤175% d, or ≥105% d and ≤150% d. Further, $W_1$ can be ≥110% d and ≤200% d, such as ≥110% d and ≤175% d, or ≥110% d and ≤150% d. Still further, $W_1$ can be ≥125% d and ≤200% d, such as ≥125% d and ≤175% d, or ≥125% d and ≤150% d.

As illustrated, the outer segment portion 134 can include an inner circumferential wall 160 and an outer circumferential wall 162. The outer segment portion 134 can also include a leading radial sidewall 164 extending between the inner circumferential wall 160 and the outer circumferential wall 162 and a trailing radial sidewall 166 extending between the inner circumferential wall 160 and the outer circumferential wall 162 opposite the leading radial sidewall 164.

As illustrated, the outer segment portion 134 can further include a second grinding face 168 that can extend between the inner and outer circumferential walls 160, 162 and the leading and trailing radial sidewalls 164, 166. Moreover, a second serrated portion 170 can extend at least partially over the second grinding face 168. In a particular aspect, the second grinding face 168 can include an area, $A_{GF2}$, and the second serrated portion 170 can include an area, $A_{SP2}$. $A_{SP2}$ can be $<A_{GF2}$. For example, $A_{SP2}$ can be ≤80% $A_{GF2}$, such as ≤75% $A_{GF2}$, ≤70% $A_{GF2}$, ≤65% $A_{GF2}$, or ≤60% $A_{GF2}$. Further, $A_{SP2}$ can be ≥30% $A_{GF2}$, such as ≥35% $A_{GF2}$, ≥40% $A_{GF2}$, ≥45% $A_{GF2}$, or ≥50% $A_{GF2}$. In another aspect, $A_{SP2}$ can be within a range between and including any of the maximum and minimum values of $A_{SP2}$ described herein.

For example, $A_{SP2}$ can be ≤80% $A_{GF2}$ and ≥30% $A_{GF2}$, such as ≤80% $A_{GF2}$ and ≥35% $A_{GF2}$, ≤80% $A_{GF2}$ and ≥40% $A_{GF2}$, ≤80% $A_{GF2}$ and ≥45% $A_{GF2}$, or ≤80% $A_{GF2}$ and ≥50% $A_{GF2}$. $A_{SP2}$ can be ≤75% $A_{GF2}$ and ≥30% $A_{GF2}$, such as ≤75% $A_{GF2}$ and ≥35% $A_{GF2}$, ≤75% $A_{GF2}$ and ≥40% $A_{GF2}$, ≤75% $A_{GF2}$ and ≥45% $A_{GF2}$, or ≤75% $A_{GF2}$ and ≥50% $A_{GF2}$. $A_{SP2}$ can be ≤70% $A_{GF2}$ and ≥30% $A_{GF2}$, such as ≤70% $A_{GF2}$ and ≥35% $A_{GF2}$, ≤70% $A_{GF2}$ and ≥40% $A_{GF2}$, ≤70% $A_{GF2}$ and ≥45% $A_{GF2}$, or ≤70% $A_{GF2}$ and ≥50% $A_{GF2}$. Further, $A_{SP2}$ can be ≤65% $A_{GF2}$ and ≥30% $A_{GF2}$, such as ≤65% $A_{GF2}$ and ≥35% $A_{GF2}$, ≤65% $A_{GF2}$ and ≥40% $A_{GF2}$, ≤65% $A_{GF2}$ and ≥45% $A_{GF2}$, or ≤65% $A_{GF2}$ and ≥50% $A_{GF2}$. Still further, $A_{SP2}$ can be ≤60% $A_{GF2}$ and ≥30% $A_{GF2}$, such as ≤60% $A_{GF2}$ and ≥35% $A_{GF2}$, ≤60% $A_{GF2}$ and ≥40% $A_{GF2}$, ≤60% $A_{GF2}$ and ≥45% $A_{GF2}$, or ≤60% $A_{GF2}$ and ≥50% $A_{GF2}$.

In a particular aspect, the outer segment portion 134 can have a second radial width, $W_2$, measured from the inner circumferential wall 160 to the outer circumferential wall 162. $W_2$ can be ≥d, described above. For example, $W_2$ can be ≥105% d, such as ≥110% d, or ≥125% d. In another aspect, $W_2$ can be ≤200% d, such as ≤175% d, or ≤150% d. $W_2$ can also be within a range between and including any of the maximum and minimum values of $W_2$ described herein.

For example, $W_2$ can be ≥105% d and ≤200% d, such as ≥105% d and ≤175% d, or ≥105% d and ≤150% d. Further, $W_2$ can be ≥110% d and ≤200% d, such as ≥110% d and ≤175% d, or ≥110% d and ≤150% d. Still further, $W_2$ can be ≥125% d and ≤200% d, such as ≥125% d and ≤175% d, or ≥125% d and ≤150% d.

In another aspect, $A_{SP1}$ can be $\leq A_{SP2}$. For example, $A_{SP1}$ can be ≤95% $A_{SP2}$, such as ≤90% $A_{SP2}$, ≤85% $A_{SP2}$, or ≤80% $A_{SP2}$. Further, $A_{SP1}$ ≥50% $A_{SP2}$, such as ≥55% $A_{SP2}$, or ≥60% $A_{SP2}$. In another aspect, $A_{SP1}$ can be within a range between and including any of the maximum and minimum values of $A_{SP1}$ described herein.

For example, $A_{SP1}$ can be ≤95% $A_{SP2}$ and ≥50% $A_{SP2}$, such as ≤95% $A_{SP2}$ and ≥55% $A_{SP2}$, or ≤95% $A_{SP2}$ and ≥60% $A_{SP2}$. $A_{SP1}$ can be ≤90% $A_{SP2}$ and ≥50% $A_{SP2}$, such as ≤90% $A_{SP2}$ and ≥55% $A_{SP2}$, or ≤90% $A_{SP2}$ and ≥60% $A_{SP2}$. Further, $A_{SP1}$ can be ≤85% $A_{SP2}$ and ≥50% $A_{SP2}$, such as ≤85% $A_{SP2}$ and ≥55% $A_{SP2}$, or ≤85% $A_{SP2}$ and ≥60% $A_{SP2}$. Moreover, $A_{SP1}$ can be ≤80% $A_{SP2}$ and ≥50% $A_{SP2}$, such as ≤80% $A_{SP2}$ and ≥55% $A_{SP2}$, or ≤80% $A_{SP2}$ and ≥60% $A_{SP2}$.

Figure 3:
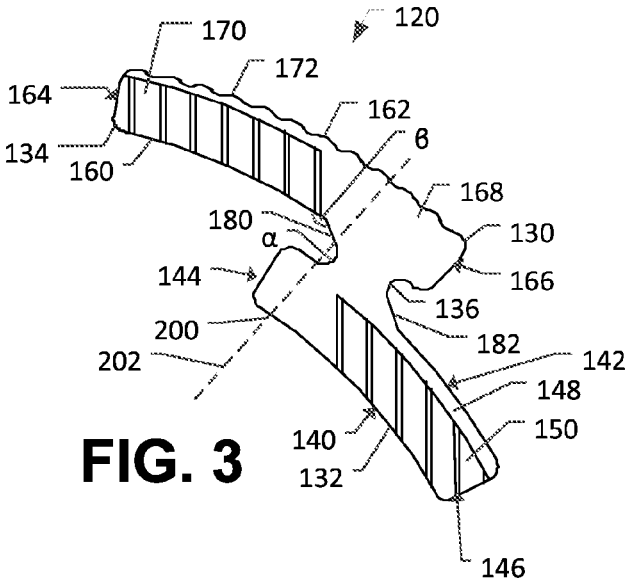
FIG. 3 includes a first plan view of a segment for an abrasive article in accordance with an embodiment.

As further depicted in FIG. 3, the outer segment portion 134 can further include a plurality of outer peripheral serrations 172 formed in the outer circumferential wall 162 of the outer segment portion 134. The outer peripheral serrations 172 can extend along the entire outer circumferential wall 162 from the leading radial sidewall 164 to the trailing radial sidewall 166 of the outer segment portion 134. Moreover, the outer peripheral serrations 172 can form a sinusoidal wave structure along the outer circumferential wall 162.

In a particular aspect, the outer circumferential wall 162 have a circumferential length, $L_{OCW}$, and the sinusoidal wave structure can includes a wavelength, $WL_{SWS}$. $WL_{SWS}$ can be ≤0.2 $L_{OCW}$, such as ≤0.175 $L_{OCW}$, ≤0.15 $L_{OCW}$, or ≤0.125 $L_{OCW}$. Further, $WL_{SWS}$ can be ≥0.05 $L_{OCW}$, such as ≥0.06 $L_{OCW}$, ≥0.07 $L_{OCW}$, ≥0.08 $L_{OCW}$, or ≥0.09 $L_{OCW}$. $WL_{SWS}$ can be within a range between and including any of the maximum and minimum values of $WL_{SWS}$ described herein.

For example, $WL_{SWS}$ can be ≤0.2 $L_{OCW}$ and ≥0.05 $L_{OCW}$, such as ≤0.2 $L_{OCW}$ and ≥0.06 $L_{OCW}$, ≤0.2 $L_{OCW}$ and ≥0.07 $L_{OCW}$, ≤0.2 $L_{OCW}$ and ≥0.08 $L_{OCW}$, or ≤0.2 $L_{OCW}$ and ≥0.09 $L_{OCW}$. In another aspect, $WL_{SWS}$ can be ≤0.175 $L_{OCW}$ and ≥0.05 $L_{OCW}$, such as ≤0.175$L_{OCW}$ and ≥0.06 $L_{OCW}$, ≤0.175 $L_{OCW}$ and ≥0.07 $L_{OCW}$, ≤0.175 $L_{OCW}$ and ≥0.08 $L_{OCW}$, or ≤0.175 $L_{OCW}$ and ≥0.09 $L_{OCW}$. Further, $WL_{SWS}$ can be ≤0.15 $L_{OCW}$ and ≥0.05 $L_{OCW}$, such as ≤0.15 $L_{OCW}$ and ≥0.06 $L_{OCW}$, ≤0.15 $L_{OCW}$ and ≥0.07 $L_{OCW}$, ≤0.15 $L_{OCW}$ and ≥0.08 $L_{OCW}$, or ≤0.15 $L_{OCW}$ and ≥0.09 $L_{OCW}$. Further still, $WL_{SWS}$ can be ≤0.125 $L_{OCW}$ and ≥0.05 $L_{OCW}$, such as ≤0.125 $L_{OCW}$ and ≥0.06 $L_{OCW}$, ≤0.125 $L_{OCW}$ and ≥0.07 $L_{OCW}$, ≤0.125 $L_{OCW}$ and ≥0.08$L_{OCW}$, or ≤0.125 $L_{OCW}$ and ≥0.09 $L_{OCW}$.

As illustrated in FIG. 3, the central segment portion 136 can include a leading radial sidewall 180 that can extend from the outer circumferential wall 142 of the inner segment portion 132 to the inner circumferential wall 160 of the outer segment portion 134. The central segment portion 136 can also include a trailing radial sidewall 182 that can extend from the outer circumferential wall 142 of the inner segment portion 132 to the inner circumferential wall 160 of the outer segment portion 134. In a particular aspect, the leading radial sidewall 180 of the central segment portion 136 can establish an acute angle, α, with respect to the outer circumferential wall 142 of the inner segment portion 132 and an obtuse angle, β, with respect the inner circumferential wall 160 of the outer segment portion 136.

In a particular aspect, α can be <90°, such as ≤75°, ≤70°, ≤65°, or ≤60°. Moreover, α can be ≥40°, such as ≥45°, ≥50°, or ≥55°. Further, α can be within a range between and including any of the values of a described herein. For example, α can be <90° and ≥40°, such as <90° and ≥45°, <90° and ≥50°, or <90° and ≥55°. Further, α can be ≤75° and ≥40°, such as ≤75° and ≥45°, ≤75° and ≥50°, or ≤75° and ≥55°. Additionally, α can be ≤70° and ≥40°, such as ≤70° and ≥45°, ≤70° and ≥50°, or ≤70° and ≥55°. In another aspect, α can be ≤65° and ≥40°, such as ≤65° and ≥45°, ≤65° and ≥50°, or ≤65° and ≥55°. Still further, α can be ≤60° and ≥40°, such as ≤60° and ≥45°, ≤60° and ≥50°, or ≤60° and ≥55°.

In another aspect, β can be >90°, such as ≥115°, ≥120°, ≥125°, or ≥130°. Moreover, β can be ≤150°, such as ≤145°, ≤140°, or ≤135°. In another aspect, β can be within a range between and including any of the maximum and minimum values of β described herein. For example, β can be >90° and ≤150°, such as >90° and ≤145°, >90° and ≤140°, or >90° and ≤135°. Additionally, β can be ≥115° and ≤150°, such as ≥115° and ≤145°, ≥115° and ≤140°, or ≥115° and ≤135°. Further, β can be ≥120° and ≤150°, such as ≥120° and ≤145°, ≥120° and ≤140°, or ≥120° and ≤135°. Further still, β can be ≥125° and ≤150°, such as ≥125° and ≤145°, ≥125° and ≤140°, or ≥125° and ≤135°. Even further, β can be ≥130° and ≤150°, such as ≥130° and ≤145°, ≥130° and ≤140°, or ≥130° and ≤135°.

Figure 9:
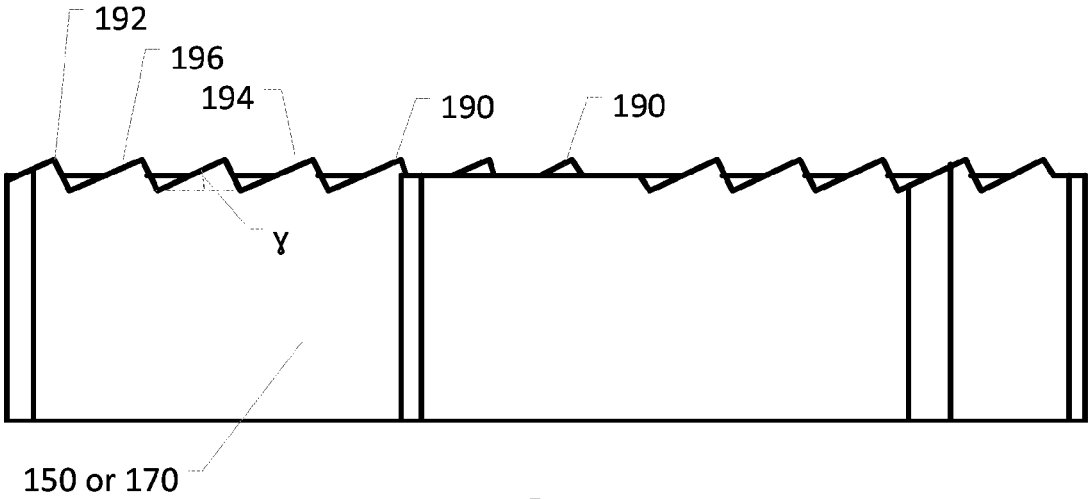
FIG. 9 includes a seventh plan view of a segment for an abrasive article in accordance with an embodiment.

As best indicated in FIG. 9, each serrated portion 150, 170 can include a plurality of serrations 190. Each serration includes a leading edge 192, a trailing edge 194, and a ramped surface 196 extending there between. In particular, each ramped surface 196 can extend at an angle, γ, into the first grinding face 148 or the second grinding face 168 from the trailing edge 194 to the leading edge 192. In a particular aspect, γ can be ≥10°, such as ≥12.5°, or ≥15°. Further, γ can be ≤30°, such as ≤25°, or ≤20°. In another aspect, γ can be within a range between and including any of the maximum and minimum values described herein.

For example, γ can be ≥10° and ≤30°, such as ≥10° and ≤25°, or ≥10° and ≤20°. Further, γ can be ≥12.5° and ≤30°, such as ≥12.5° and ≤25°, or ≥12.5° and ≤20°. Still further, γ can be ≥15° and ≤30°, such as ≥15° and ≤25°, or ≥15° and ≤20°.

In a particular aspect, the abrasive segment 120 can include a thickness, $T_{AS}$, measured from a rear face to a front face, e.g., the first grinding face 148 or the second grinding face 168. The trailing edge 194 of each serration 190 can extend a distance, $D_{TES}$, out from the first grinding face 148 or the second grinding face 168 and measured perpendicular to the first grinding face 148 or the second grinding face 168 and $D_{TES}$ can be ≤0.125 $T_{AS}$, such as ≤0.1 $T_{AS}$, ≤0.075 $T_{AS}$, or ≤0.05 $T_{AS}$. Moreover, $D_{TES}$ can be ≥0.0075 $T_{AS}$, such as ≥0.01 $T_{AS}$, ≥0.0125 $T_{AS}$, or ≥0.015 $T_{AS}$. In another aspect, $D_{TES}$ can be within a range between and including any of the maximum or minimum values of $D_{TES}$ described herein.

For example, $D_{TES}$ can be ≤0.125 $T_{AS}$ and ≥0.0075 $T_{AS}$, such as ≤0.125 $T_{AS}$ and ≥0.01 $T_{AS}$, ≤0.125 $T_{AS}$ and ≥0.0125 $T_{AS}$, or ≤0.125 $T_{AS}$ and ≥0.015 $T_{AS}$. Further, $D_{TES}$ can be ≤0.1 $T_{AS}$ and ≥0.0075 $T_{AS}$, such as ≤0.1 $T_{AS}$ and ≥0.01 $T_{AS}$, ≤0.1 $T_{AS}$ and ≥0.0125 $T_{AS}$, or ≤0.1 $T_{AS}$ and ≥0.015 $T_{AS}$. Further still, $D_{TES}$ can be ≤0.075 $T_{AS}$ and ≥0.0075 $T_{AS}$, such as ≤0.075 $T_{AS}$ and ≥0.01 $T_{AS}$, ≤0.075 $T_{AS}$ and ≥0.0125 $T_{AS}$, or ≤0.075 $T_{AS}$ and ≥0.015 $T_{AS}$. Even further, $D_{TES}$ can be ≤0.05 $T_{AS}$ and ≥0.0075 $T_{AS}$, such as ≤0.05 $T_{AS}$ and ≥0.01 $T_{AS}$, ≤0.05 $T_{AS}$ and ≥0.0125 $T_{AS}$, or ≤0.05 $T_{AS}$ and ≥0.015 $T_{AS}$.

The leading edge 192 of each serration 190 can extend a distance, $D_{LES}$, into the first grinding face 148 or the second grinding face 168 and measured perpendicular to the first grinding face 148 or the second grinding face 168, and $D_{LES}$ can be ≤0.125 $T_{AS}$, such as ≤0.1 $T_{AS}$, ≤0.075 $T_{AS}$, or ≤0.05 $T_{AS}$. Moreover, $D_{LES}$ can be ≥0.0075 $T_{AS}$, such as ≥0.01 $T_{AS}$, ≥0.0125 $T_{AS}$, or ≥0.015 $T_{AS}$. In another aspect, $D_{LES}$ can be within a range between and including any of the maximum or minimum values of $D_{LES}$ described herein.

For example, $D_{LES}$ can be ≤0.125 $T_{AS}$ and ≥0.0075 $T_{AS}$, such as ≤0.125 $T_{AS}$ and ≥0.01 $T_{AS}$, ≤0.125 $T_{AS}$ and ≥0.0125 $T_{AS}$, or ≤0.125 $T_{AS}$ and ≥0.015 $T_{AS}$. Further, $D_{LES}$ can be ≤0.1 $T_{AS}$ and ≥0.0075 $T_{AS}$, such as ≤0.1 $T_{AS}$ and ≥0.01 $T_{AS}$, ≤0.1 $T_{AS}$ and ≥0.0125 $T_{AS}$, or ≤0.1 $T_{AS}$ and ≥0.015 $T_{AS}$. Further still, $D_{LES}$ can be ≤0.075 $T_{AS}$ and ≥0.0075 $T_{AS}$, such as ≤0.075 $T_{AS}$ and ≥0.01 $T_{AS}$, ≤0.075 $T_{AS}$ and ≥0.0125 $T_{AS}$, or ≤0.075 $T_{AS}$ and ≥0.015 $T_{AS}$. Even further, $D_{LES}$ can be ≤0.05 $T_{AS}$ and ≥0.0075 $T_{AS}$, such as ≤0.05 $T_{AS}$ and ≥0.01 $T_{AS}$, ≤0.05 $T_{AS}$ and ≥0.0125 $T_{AS}$, or ≤0.05 $T_{AS}$ and ≥0.015 $T_{AS}$.

In another particular aspect, the abrasive segment 120 can include a central axis 200 that can extend through a center 202 of curvature of the abrasive segment and bisect the leading radial sidewall 180 of the central segment portion 136 of the abrasive segment 120. In this aspect, the first serrated portion 150 on the first segment portion 132 can lie entirely behind the central axis 200 with respect to a direction of rotation of the abrasive segment 120. Further, the second serrated portion 170 on the second segment portion 134 can lie entirely ahead of the central axis 200 with respect to a direction of rotation of the abrasive segment 120.

Further, in a particular aspect, a portion of the inner segment portion 132 can extend ahead of the leading radial sidewall 180 of the central segment portion 136 with respect to the direction of rotation. Moreover, a portion of the outer segment portion 134 can extend behind the trailing radial sidewall 182 of the central segment portion 136 with respect to the direction of rotation.

In a particular aspect, the core 102 of the abrasive article 100 described herein can be in the form of a cup, a ring, a ring section, a plate, or a disc depending upon the intended application of the abrasive article. The core 102 can be made of a metal or metal alloy. For instance, the core 102 can be made of steel, and particularly, a heat treatable steel alloys, such as 25CrMo4, 75Cr1, C60, or similar steel alloys for a core having a thin cross section or simple construction steel like St 60 or similar for a thick core. The core 102 can have a tensile strength of at least about 600 $N/mm^2$. The core 102 can be formed by a variety of metallurgical techniques known in the art.

In an exemplary embodiment, the abrasive segments 104 can include abrasive particles embedded in a bond matrix. In a particular aspect, the bond matrix can include a metal matrix having a network of interconnected pores. The abrasive particles can include an abrasive material having a Mohs hardness of at least about 7. In particular instances, the abrasive particles can include a superabrasive material, such as diamond or cubic boron nitride. The abrasive particles can have a particle size of not less than about 400 US mesh, such as not less than about 100 US mesh, such as between about 25 and 80 US mesh. Depending on the application, the size can be between about 30 and 60 US mesh.

The abrasive particles can be present in an amount between about 2 vol % to about 50 vol %. Additionally, the amount of abrasive particles may depend on the application. For example, an abrasive segment for a grinding or polishing tool can include between about 3.75 and about 50 vol % abrasive particles of the total volume of the abrasive segment. Alternatively, an abrasive segment for a cutting-off tool can include between about 2 vol % and about 6.25 vol % abrasive particles of the total volume of the abrasive segment. Further, an abrasive segment for core drilling can include between about 6.25 vol % and about 20 vol % abrasive particles of the total volume of the abrasive segment.

The metal matrix can include a metal element or metal alloy including a plurality of metal elements. For certain abrasive segments, the metal matrix can include metal elements such as iron, tungsten, cobalt, nickel, chromium, titanium, silver, and a combination thereof. In particular instances, the metal matrix can include a rare earth element such as cerium, lanthanum, neodymium, and a combination thereof.

In one particular example, the metal matrix can include a wear resistant component. For example, in one embodiment, the metal matrix can include tungsten carbide, and more particularly, may consist essentially of tungsten carbide.

In certain designs, the metal matrix can include particles of individual components or pre-alloyed particles. The particles can be between about 1.0 microns and about 250 microns.

In a particular aspect, the abrasive segments 104 can be formed such that an infiltrant is present within the interconnected network of pores within the body of the abrasive segment 104. The infiltrant can partially fill, substantially fill, or even completely fill the volume of the pores extending through the volume of the abrasive segment 104. In accordance with one particular design, the infiltrant can be a metal or metal alloy material. For example, some suitable metal elements can include copper, tin, zinc, and a combination thereof.

In particular instances, the infiltrant can be a bronzing material made of a metal alloy, and particular a copper-tin metal alloy, such that it is particularly suited for welding according to embodiments herein. For example, the bronzing material can consist essentially of copper and tin. Certain bronzing materials can incorporate particular contents of tin greater than about 5% by weight, such as greater than about 6% by weight, greater than about 7% by weight, or even greater than about 8% by weight. Further, certain bronzing materials can incorporate particular contents of tin less than about 20% by weight, such as less than about 15% by weight, less than about 12% by weight, or even less than about 10% by weight of the total amount of materials within the composition.

In accordance with an embodiment, the bronzing material can include an amount of tin within a range between and including about 5% by weight and about 20% by weight, such as between and including about 5% by weight and about 15% by weight, between and including about 5% by weight and about 12% by weight, or between and including about 5% by weight and about 10% by weight.

In another embodiment, the bronzing material can include an amount of tin within a range between and including about 6% by weight and about 20% by weight, such as between and including about 6% by weight and about 15% by weight, between and including about 6% by weight and about 12% by weight, or between and including about 6% by weight and about 10% by weight.

Further, in yet another embodiment, the bronzing material can include an amount of tin within a range between and including about 7% by weight and about 20% by weight, such as between and including about 7% by weight and about 15% by weight, between and including about 7% by weight and about 12% by weight, or between and including about 7% by weight and about 10% by weight.

Still further, in accordance with another embodiment, the bronzing material can include an amount of tin within a range between and including about 8% by weight and about 20% by weight, such as between and including about 8% by weight and about 15% by weight, between and including about 8% by weight and about 12% by weight, or between and including about 8% by weight and about 10% by weight.

Moreover, certain bronzing materials can be used as infiltrant material, and can have an amount of copper of at least about 80%, at least about 85%, or even at least about 88% by weight of the total amount of materials within the composition. Some bronzing materials can utilize an amount of copper within a range between about 80% and about 95%, such as between about 85% and about 95%, or even between about 88% and about 93% by weight of the total amount of materials within the composition.

Additionally, the bronzing material may contain a particularly low content of other elements, such as zinc to facilitate proper formation of the abrasive article according to the forming methods of the embodiments herein. For example, the bronzing material may utilize not greater than about 10%, such as not greater than about 5%, or even not greater than about 2% zinc. In fact, certain bronzing materials can be essentially free of zinc.

The abrasive segment 104 may be manufactured, such that abrasive particles can be combined with a metal matrix to form a mixture. The metal matrix can include a blend of particles of the components of the metal matrix or can be pre-alloyed particles of the metal matrix. In an embodiment, the metal matrix can conform to the formula $(WC)_wW_xFe_yCr_zX_{(1-w-x-y-z)}$, wherein $0 \le w \le 0.8$, $0 \le x \le 0.7$, $0 \le y \le 0.8$, $0 \le z \le 0.05$, $w+x+y+z \le 1$, and X can include other metals such as cobalt and nickel. In another embodiment, the metal matrix can conform to the formula $(WC)_wW_xFe_yCr_zAg_vX_{(1-v-w-x-y-z)}$, wherein $0 \le w \le 0.5$, $0 \le x \le 0.4$, $0 \le y \le 1.0$, $0 \le z \le 0.05$, $0 \le v \le 0.1$, $v+w+x+y+z \le 1$, and X can include other metals such as cobalt and nickel.

The mixture of metal matrix and abrasive particles can be formed into an abrasive preform by a pressing operation, particularly a cold pressing operation, to form a porous abrasive segment. The cold pressing can be carried out at a pressure within a range between and including about 50 kN/cm$^2$ (500 MPa) to about 250 kN/cm$^2$ (2500 MPa). The resulting porous abrasive segment can have a network of interconnected pores. In an example, the porous abrasive segment can have a porosity between about 25 and 50 vol %.

The resulting porous abrasive segment 104 can then be subject to an infiltration process, wherein the infiltrant material is disposed within the body of the abrasive segment, and particularly, disposed within the interconnected network of pores within the body of the abrasive segment. The infiltrant may be drawn into the pores of the cold pressed abrasive segment via capillary action. After the infiltration process, the resulting densified abrasive segment can be not less than about 96% dense. The amount of infiltrant that infiltrates the abrasive segment can be between about 20 wt % and 45 wt % of the densified abrasive segment.

The abrasive segment 104 can include a backing region, disposed between the abrasive segment and the base, i.e., the core 102, which facilitates the joining of the abrasive segment and the core 102. According to one embodiment, the backing region can be a distinct region from the abrasive segment 104 and the core 102. Still, the backing region can be initially formed as part of the abrasive segment 104, and particularly may be a distinct region of the abrasive segment 104 along a bottom surface of the abrasive segment 104 that has particular characteristics facilitating the joining of the abrasive segment 104 and the core 102. For example, according to one embodiment, the backing region can have a lesser percentage (vol %) of abrasive particles as compared to the amount of abrasive particles within the abrasive segment 104. In fact, in certain instances, the backing region can be essentially free of abrasive particles. This may be particularly suitable for forming methods utilizing a beam of energy (e.g., a laser) used to weld the abrasive segment 104 to the core 102.

At least a portion of the backing region can include a bonding composition. The bonding composition can include a metal or metal alloy. Some suitable metal materials can include transition metal elements, including for example, titanium, silver, manganese, phosphorus, aluminum, magnesium, chromium, iron, lead, copper, tin, and a combination thereof.

In particular instances, the bonding composition can be similar to the infiltrant, such that the bonding composition and the infiltrant are different from each other by not greater than a single elemental species. In even more particular instances, the bonding composition can be the same as the infiltrant. According to embodiments herein, the bonding composition can be related to the infiltrant composition in having a certain degree of commonality of elemental species. Quantitatively, an elemental weight percent difference between the bonding composition and the infiltrant composition does not exceed 20 weight percent. Elemental weight percent difference is defined as the absolute value of the difference in weight content of each element contained in the bonding composition relative to the infiltrant composition. Other embodiments have closer compositional relationships between the bonding composition and the composition of the infiltrant. The elemental weight percent difference between the bonding composition and the infiltrant composition may, for example, not exceed 15 weight percent, 10 weight percent, 5 weight percent, or may not exceed 2 weight percent. An elemental weight percent difference of about zero represents the same composition making up the backing region and the infiltrant. The foregoing elemental values may be measured by any suitable analytical means, including microprobe elemental analysis, and ignores alloying that might take place along areas in which the infiltrant contacts the metal matrix.

The backing region can include at least about 90 wt % infiltrant, such as at least about 95 wt % infiltrant, such as at least about 98 wt % infiltrant. The infiltrant can be continuous throughout the backing region and the densified abrasive segment. In certain instances, the backing region can be formed primarily of the infiltrant material, and in more particular instances, can consist essentially of the infiltrant material. Still, in other embodiments, the backing region can be an infiltrated region, like the abrasive segment. Accordingly, the backing region can include a network of interconnected pores formed between a matrix metal, and wherein the infiltrant material substantially fills the interconnected pores. The backing region can contain similar amounts of matrix metal and infiltrant. Notably, the backing region may be essentially free of abrasive particles. In such embodiments wherein the backing region includes interconnected pores substantially filled with the infiltrant, the infiltrant material can act as a bronzing material in forming a joint (e.g., a welded joint) between the base and the abrasive segment.

In one embodiment, the backing region can be formed of the bronzing material described herein. In fact, certain backing regions can consist essentially of a copper-tin bronzing material having about 88% copper and 12% tin or 90% copper and 10% tin.

In a particular aspect, a method of making the abrasive article 100 can include stamping, cutting, drilling, or otherwise forming a core 102 having vibration reducing gullets 140 and segment support structures 130. The method can include affixing the segments 104 to the core 102 such that each segment 104 is affixed to a segment support structure 130. Affixing the segments 104 to the core 102 can include welding the abrasive segments 104 to the core 102. In particular, the welding process can include impinging a beam of energy at the base of each segment 104. More particularly, in the instance of a segment 104 having a backing region, welding can include impinging a beam of energy at the backing region between the abrasive segment 104 and the core 102. In particular instances, the beam of energy can be a laser, such that each abrasive segment 104 is attached to the core 102 via a laser welded bond joint. The laser may be a Roffin laser source commonly available from Dr. Fritsch, GmbH.

In one aspect, each segment 104 can be formed by pressing a green segment in a mold and curing the green segment. The pressing can include hot pressing or cold pressing. In another aspect, forming each segment 104 can include sintering a green segment, e.g., using an electro-discharge sintering process. In yet another aspect, forming each segment 104 can include the infiltration method described herein.

In another aspect, each segment 104 can be include a single layer metal bond ("SLMB") segment having a core and a single layer of abrasive electro-plated, or otherwise deposited, on a cutting, or grinding surface of the core.

According to an embodiment, each abrasive article 100 can include a carrier element, e.g., a core 102, and an abrasive component, e.g., a segment 104. The abrasive article 100 can be a cutting tool for cutting construction materials, such as a saw for cutting concrete. Alternatively, the abrasive article 100 can be a grinding tool such as for grinding concrete or fired clay or removing asphalt.

Items.

Item 1. An abrasive segment, comprising:

an inner segment portion comprising an inner circumferential wall, an outer circumferential wall, a leading radial sidewall extending between the inner circumferential wall and the outer circumferential wall, and a trailing radial sidewall extending between the inner circumferential wall and the outer circumferential wall opposite the leading radial sidewall;

an outer segment portion spaced a radial distance, d, from the inner segment portion, the outer segment portion comprising an inner circumferential wall, an outer circumferential wall, a leading radial sidewall extending between the inner circumferential wall and the outer circumferential wall, and a trailing radial sidewall extending between the outer circumferential wall and the inner circumferential wall opposite the leading radial sidewall; and a central segment portion connected to the inner segment portion and the outer segment portion, the central segment portion including a leading radial sidewall and a trailing radial sidewall, wherein the leading radial sidewall of the central segment portion establishes an acute angle, $\alpha$, with respect to the outer circumferential wall of the inner segment portion and an obtuse angle, $\beta$, with respect the inner circumferential wall of the outer segment portion.

Item 2. An abrasive article, comprising:

a body;

a plurality of Z-shaped abrasive segments extending from a face of the body, wherein each Z-shaped abrasive segment comprises:

an inner segment;

an outer segment portion spaced a radial distance, d, from the inner segment portion; and a central segment portion connected to the inner segment portion and the outer segment portion.

Item 3. An abrasive article, comprising:

a body;

a plurality of Z-shaped abrasive segments extending from a face of the body, wherein each abrasive segment comprises:

an inner segment portion comprising a first grinding face and a first serrated portion extending at least partially over the first grinding face;

an outer segment portion spaced a radial distance, d, from the inner segment portion, the outer segment portion comprising a second grinding face and a second serrated portion extending at least partially over the second grinding face; and a central segment portion connected to the inner segment portion and the outer segment portion.

Item 4. The abrasive article according to claim 3, wherein each serrated portion includes a plurality of serrations and each serration includes a leading edge, a trailing edge, and a ramped surface that extends at an angle, $\gamma$, into the first grinding face or the second grinding face from the trailing edge to the leading edge.

Item 5. The abrasive article according to claim 4, wherein $\gamma \geq 10°$, such as $\geq 12.5°$, or $\geq 15°$.

Item 6. The abrasive article according to claim 5, wherein $\gamma \leq 30°$, such as $\leq 25°$, or $\leq 20°$.

Item 7. The abrasive segment or article according to claim 4, wherein the abrasive segment includes a thickness, $T_{AS}$, and the trailing edge of each serration extends a distance, $D_{TES}$, outward from the first grinding face or the second grinding face, wherein $D_{TES} \leq 0.125\ T_{AS}$, such as $\leq 0.1\ T_{AS}$, $\leq 0.075\ T_{AS}$, or $\leq 0.05\ T_{AS}$.

Item 8. The abrasive segment or article according to claim 7, wherein $D_{TES} > 0.0075\ T_{AS}$, such as $\geq 0.01\ T_{AS}$, $\geq 0.0125\ T_{AS}$, or $\geq 0.015\ T_{AS}$.

Item 9. The abrasive segment or article according to claim 4, wherein the abrasive segment includes a thickness, $T_{AS}$, and the trailing edge of each serration extends a distance, $D_{LES}$, inward from the first grinding face or the second grinding face, wherein $D_{LES} \leq 0.125\ T_{AS}$, such as $\leq 0.1\ T_{AS}$, $\leq 0.075\ T_{AS}$, or $\leq 0.05\ T_{AS}$.

Item 10. The abrasive segment or article according to claim 9, wherein $D_{LES} > 0.0075\ T_{AS}$, such as $\geq 0.01\ T_{AS}$, $\geq 0.0125\ T_{AS}$, or $\geq 0.015\ T_{AS}$.

Item 11. The abrasive segment or article according to of claim 1, wherein $\alpha$ is $<90°$, such as $\leq 75°$, $\leq 70°$, $\leq 65°$, or $\leq 60°$.

Item 12. The abrasive segment or article according to claim 11, wherein $\alpha$ is $\geq 40°$, such as $\geq 45°$, $\geq 50°$, or $\geq 55°$.

Item 13. The abrasive segment or article according to any of claims 1, wherein $\beta > 90°$, such as $\geq 115°$, $\geq 120°$, $\geq 125°$, or $\geq 130°$.

Item 14. The abrasive segment or article according to claim 13, wherein $\alpha$ is $\leq 150°$, such as $\leq 145°$, $\leq 140°$, or $\leq 135°$.

Item 15. The abrasive segment or article according to any of claim 1 or 2, wherein the inner segment portion further comprises a grinding face extending between the inner and outer circumferential walls, the leading radial sidewall, and the trailing radial sidewall wherein the first grinding face includes a first serrated portion extending at least partially over the first grinding face.

Item 16. The abrasive segment or article according to claim 15, wherein the first grinding face includes an area, $A_{GF1}$, and the first serrated portion includes an area, $A_{SP1}$, and $A_{SP1} < A_{GF1}$.

Item 17. The abrasive segment or article according to claim 16, wherein $A_{SP1} < 80\%\ A_{GF1}$, such as $\leq 75\%\ A_{GF1}$, $<70\%\ A_{GF1}$, $<65\%\ A_{GF1}$, or $\leq 60\%\ A_{GF1}$.

Item 18. The abrasive segment or article according to claim 17, wherein $A_{SP1} \geq 30\%\ A_{GF1}$, such as $\geq 35\%\ A_{GF1}$, $>40\%\ A_{GF1}$, $\geq 45\%\ A_{GF1}$, or $\geq 50\%\ A_{GF1}$.

Item 19. The abrasive segment or article according to claim 15, wherein the outer segment portion further comprises a second grinding face extending between the inner and outer circumferential walls, the leading radial sidewall, and the trailing radial sidewall wherein the second grinding face includes a second serrated portion extending at least partially over the second grinding face.

Item 20. The abrasive segment or article according to claim 19, wherein the second grinding face includes an area, $A_{GF2}$, and the second serrated portion includes an area, $A_{SP2}$, and $A_{SP2} < A_{GF2}$.

Item 21. The abrasive segment or article according to claim 20, wherein $A_{SP2} \leq 80\%\ A_{GF2}$, such as $\leq 75\%\ A_{GF2}$, $\leq 70\%\ A_{GF2}$, $\leq 65\%\ A_{GF2}$, or $\leq 60\%\ A_{GF2}$.

Item 22. The abrasive segment or article according to claim 21, wherein $A_{SP2} \geq 30\%\ A_{GF2}$, such as $\geq 35\%\ A_{GF2}$, $\geq 40\%\ A_{GF2}$, $\geq 45\%\ A_{GF2}$, or $\geq 50\%\ A_{GF2}$.

Item 23. The abrasive segment or article according to claim 19, wherein the first serrated portion includes an area, $A_{SP1}$, and the second serrated portion includes an area $A_{SP2}$, wherein $A_{SP1} \leq A_{SP2}$.

Item 24. The abrasive segment or article according to claim 23, wherein $A_{SP1} \leq 95\%\ A_{SP2}$, such as $\leq 90\%\ A_{SP2}$, $\leq 85\%\ A_{SP2}$, $\leq 80\%\ A_{SP2}$, or $\leq 75\%\ A_{SP2}$.

Item 25. The abrasive segment or article according to claim 24, wherein $A_{SP1} \geq 50\%\ A_{SP2}$, such as $\geq 55\%\ A_{SP2}$, or $\geq 60\%\ A_{SP2}$.

Item 26. The abrasive segment or article according to claim 19, wherein the abrasive segment includes a central axis extending through a center of curvature of the abrasive segment and bisecting the leading radial sidewall of the central segment portion of the abrasive segment and wherein the first serrated portion lies entirely behind the central axis with respect to a direction of rotation of the abrasive segment.

Item 27. The abrasive segment or article according to claim 26, wherein the second serrated portion lies entirely ahead of the central axis with respect to a direction of rotation of the abrasive segment.

Item 28. The abrasive segment or article according to any of claim 1, 2, or 3, wherein the outer segment portion further comprises a plurality of outer peripheral serrations formed in the outer circumferential wall of the outer segment portion.

Item 29. The abrasive segment or article according to claim 28, wherein the outer peripheral serrations extend along the entire outer circumferential wall from the leading radial sidewall to the trailing radial sidewall.

Item 30. The abrasive segment or article according to claim 29, wherein the outer peripheral serrations form a sinusoidal wave structure along the outer circumferential wall.

Item 31. The abrasive segment or article according to claim 30, wherein the outer circumferential wall has a length, $L_{OCW}$, and the sinusoidal wave structure includes a wavelength, $WL_{SWS}$, wherein $WL_{SWS} \leq 0.2\ L_{OCW}$, such as $\leq 0.175\ L_{OCW}$, $\leq 0.15\ L_{OCW}$, or $\leq 0.125\ L_{OCW}$.

Item 32. The abrasive segment or article according to claim 30, wherein $WL_{SWS} \geq 0.05\ L_{OCW}$, such as $\geq 0.06\ L_{OCW}$, $\geq 0.07\ L_{OCW}$, $\geq 0.08\ L_{OCW}$, or $\geq 0.09\ L_{OCW}$.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. An abrasive segment, comprising:

an inner segment portion comprising an inner circumferential wall, an outer circumferential wall, a leading radial sidewall extending between the inner circumferential wall and the outer circumferential wall, and a trailing radial sidewall extending between the inner circumferential wall and the outer circumferential wall opposite the leading radial sidewall;

an outer segment portion spaced a radial distance, d, from the inner segment portion, the outer segment portion comprising an inner circumferential wall, an outer circumferential wall, a leading radial sidewall extending between the inner circumferential wall and the outer circumferential wall, and a trailing radial sidewall extending between the outer circumferential wall and the inner circumferential wall opposite the leading radial sidewall; and a central segment portion connected to the inner segment portion and the outer segment portion, the central segment portion including a leading radial sidewall and a trailing radial sidewall, wherein the leading radial sidewall of the central segment portion establishes an acute angle, $\alpha$, with respect to the outer circumferential wall of the inner segment portion and an obtuse angle, $\beta$, with respect the inner circumferential wall of the outer segment portion.

2. The abrasive segment or article according to of claim 1, wherein $\alpha$ is $<90°$.

3. The abrasive segment or article according to claim 2, wherein $\alpha$ is $>40$.

4. The abrasive segment or article according to any of claims 1, wherein $\beta>90$.

5. The abrasive segment or article according to claim 4, wherein $\alpha$ is $<150$.

6. The abrasive segment according to claim 1, wherein the inner segment portion further comprises a grinding face extending between the inner and outer circumferential walls, the leading radial sidewall, and the trailing radial sidewall wherein the first grinding face includes a first serrated portion extending at least partially over the first grinding face.

7. The abrasive segment according to claim 6, wherein the first grinding face includes an area, $A_{GF1}$, and the first serrated portion includes an area, $A_{SP1}$, and $A_{SP1}<A_{GFl}$.

8. The abrasive segment according to claim 6, wherein the outer segment portion further comprises a second grinding face extending between the inner and outer circumferential walls, the leading radial sidewall, and the trailing radial sidewall wherein the second grinding face includes a second serrated portion extending at least partially over the second grinding face.

9. The abrasive segment according to claim 8, wherein the second grinding face includes an area, $A_{GF2}$, and the second serrated portion includes an area, $A_{SP2}$, and $A_{SP2} <A_{GF2}$.

10. The abrasive segment according to claim 8, wherein the first serrated portion includes an area, $A_{SP1}$, and the second serrated portion includes an area $A_{SP2}$, wherein $A_{SP1}<A_{SP2}$.

11. The abrasive segment according to claim 8, wherein the abrasive segment includes a central axis extending through a center of curvature of the abrasive segment and bisecting the leading radial sidewall of the central segment portion of the abrasive segment and wherein the first serrated portion lies entirely behind the central axis with respect to a direction of rotation of the abrasive segment.

12. The abrasive segment according to claim 11, wherein the second serrated portion lies entirely ahead of the central axis with respect to a direction of rotation of the abrasive segment.

13. The abrasive segment according to claim 1, wherein the outer segment portion further comprises a plurality of outer peripheral serrations formed in the outer circumferential wall of the outer segment portion.

14. The abrasive segment according to claim 13, wherein the outer peripheral serrations extend along the entire outer circumferential wall from the leading radial sidewall to the trailing radial sidewall.

15. An abrasive article, comprising:

a body;

a plurality of Z-shaped abrasive segments extending from a face of the body, wherein each abrasive segment comprises:

an inner segment portion comprising a first grinding face and a first serrated portion extending at least partially over the first grinding face;

an outer segment portion spaced a radial distance, d, from the inner segment portion, the outer segment portion comprising a second grinding face and a second serrated portion extending at least partially over the second grinding face; and a central segment portion connected to the inner segment portion and the outer segment portion.

16. The abrasive article according to claim 15, wherein each serrated portion includes a plurality of serrations and each serration includes a leading edge, a trailing edge, and a ramped surface that extends at an angle, $\gamma$, into the first grinding face or the second grinding face from the trailing edge to the leading edge.

17. The abrasive article according to claim 15, wherein $\gamma>10$, and wherein $\gamma<30$.

18. The abrasive segment or article according to claim 15, wherein the abrasive segment includes a thickness, $T_{AS}$, and the trailing edge of each serration extends a distance, $D_{TES}$, outward from the first grinding face or the second grinding face, and wherein $D_{TES}<0.125\ T_{AS}$.

19. The abrasive segment or article according to claim 15, wherein the abrasive segment includes a thickness, $T_{AS}$, and the trailing edge of each serration extends a distance, $D_{LES}$, inward from the first grinding face or the second grinding face, wherein $D_{LES}<0.125\ T_{AS}$.

20. An abrasive article, comprising:

a body;

a plurality of Z-shaped abrasive segments extending from a face of the body, wherein each Z-shaped abrasive segment comprises:

an inner segment portion comprising an inner circumferential wall, an outer circumferential wall, a leading radial sidewall extending between the inner circumferential wall and the outer circumferential wall, and a trailing radial sidewall extending between the inner circumferential wall and the outer circumferential wall opposite the leading redial sidewall;

an outer segment portion spaced a radial distance, d, from the inner segment portion, the outer segment portion comprising an inner circumferential wall, an outer circumferential wall, a leading radial sidewall extending between the inner circumferential wall and the outer circumferential wall, and a trailing radial sidewall extending between the outer circumferential wall and the inner circumferential wall opposite the leading radial sidewall; and a central segment portion connected to the inner segment portion and the outer segment portion.

* * * * *